United States Patent [19]

Thompson

[11] Patent Number: 4,771,137

[45] Date of Patent: Sep. 13, 1988

[54] ELECTRIC FENCE WIRE INSULATOR

[76] Inventor: Donald G. Thompson, P.O. Box 1452, Sisters, Oreg. 97759

[21] Appl. No.: 107,712

[22] Filed: Oct. 13, 1987

[51] Int. Cl.[4] ..... H01B 17/16; H01B 17/24

[52] U.S. Cl. ..... 174/163 F; 174/166 R; 174/172; 174/175; 248/218.4; D13/18

[58] Field of Search ..... 174/45 R, 158 R, 158 F, 174/161 F, 163 R, 163 F, 164, 166 R, 169, 172, 175; 248/218.4, 219.1; 256/3, 4, 10, 11; D13/17, 18

[56] References Cited

U.S. PATENT DOCUMENTS

| | | | |
|---|---|---|---|
| 2,051,302 | 8/1936 | Lefforge | 256/11 |
| 2,856,159 | 10/1958 | Braddock | 256/10 X |
| 2,896,011 | 7/1959 | Huseby | 174/163 F |
| 3,652,780 | 3/1972 | Wilson | 174/163 F X |
| 3,689,686 | 9/1972 | Wilson | 174/158 F X |
| 3,749,819 | 7/1973 | Wilson | 174/158 F |
| 3,749,820 | 7/1973 | Langlie et al. | 174/163 F |
| 3,752,902 | 8/1973 | Wilson | 174/163 F |
| 3,801,731 | 4/1974 | Hansen | 174/163 F |
| 4,077,611 | 3/1978 | Wilson | 174/163 F |
| 4,263,477 | 4/1981 | Wilson, Sr. | 174/158 F |
| 4,599,488 | 7/1986 | Wilson, Jr. | 174/158 F |
| 4,623,756 | 11/1986 | Wilson, Jr. | 174/158 F |

FOREIGN PATENT DOCUMENTS

| | | | |
|---|---|---|---|
| 754049 | 8/1956 | United Kingdom | 174/163 F |

*Primary Examiner*—Laramie E. Askin
*Attorney, Agent, or Firm*—Olson and Olson

[57] ABSTRACT

An electric fence wire insulator is formed as an integral, one-piece body of non-conductive synthetic resin and includes a transverse spark shield from which extends in one direction a pair of laterally spaced main legs terminating in a pair of laterally spaced feet configured to abut the arcuate or flat surface of a wooden or metal fence post. Openings through the feet receive nails or screws by which to secure the feet to the fence post. Projecting in the opposite direction from the spark shield are five laterally spaced fingers provided with inwardly facing arcuate grooves which are aligned transversely for the reception of an electric fence wire. Laterally spaced secondary legs inwardly of the main legs are shaped to provide two pairs of split circular retainers of different diameters for the frictional retention of different size rod type fence posts. Inwardly facing sockets on the main legs adjacent the feet frictionally grip between them the laterally extending arms of a T type fence post, the central leg of which may extend into the space between the split retainers of the secondary legs. A pair of shoulders on the main legs are spaced from the spark shield to form a pair of grooves therebetween for the reception of the U-shaped mounting end of a stand-off wire the opposite of which is formed with an open loop for the removable reception of an electric fence wire.

11 Claims, 3 Drawing Sheets

ELECTRIC FENCE WIRE INSULATOR

BACKGROUND OF THE INVENTION

This invention relates to electric wire fences, and more particularly to a novel electric wire fence insulator bracket configured to mount an electric fence wire to virtually any conventional type of post typically used in area fencing.

Electrified fences are well known in the farming and ranching art, and typically involve stringing bare electric wire around the perimeter of a desired area. The wire is supported by fence posts mounting non-conductive brackets configured to hold the wire a desired elevated distance above the ground. Depending on various factors, however, fence posts may typically be wood, "T" type metal posts, or various diameter metal rod stock, depending on the type of animal that is to be governed by the fence.

With it understood therefore that electric wire fences, either smooth wire or barbed, are erected using a plurality of any one of a variety of different types of posts, and with it also understood that each fence post mounts a bracket that supports a fence wire, it can be seen that the wire-supporting bracket must be configured to be mountable on whichever particular type of fence post is being used.

Accordingly, the fencing industry heretofore has provided a multitude of different brackets in a multitude of various sizes, styles and configurations to accommodate the purchaser's fencing needs. As an example, one well known manufacturer provides the marketplace with 27 different brackets to accommodate the purchasing public's various requirements. A supply store must, in order to maintain a minimum working inventory, stock large numbers of at least eight different types of these brackets. Another manufacturer offers 34 different types of brackets in order to accommodate the multitude of different fence posts, wire types, spacing needs, etc. The result is excessive manufacturing expenses, inventory problems, storage space and stock expenses for the supplier, and a great deal of confusion to the buyer in his purchasing efforts and obviously also to the installer in the process of constructing a fence.

Typical of brackets common in the art are those disclosed in U.S. Pat. Nos. 3,652,780; 3,689,686; 3,749,819; 3,752,902; 3,801,731; 4,077,611; 4,263,477; 4,599,488; and 4,623,756.

SUMMARY OF THE INVENTION

In its basic concept, this invention provides a wire supporting fence post bracket that is specifically configured for universal mounting to all conventional types of fence posts commonly used in the wire fencing art.

It is by virtue of the foregoing basic concept that the principal object of this invention is achieved; namely, the provision of an electric wire supporting fence post bracket that overcomes the disadvantages and limitations of brackets of the prior art.

Another object of this invention is the provision of a fence post bracket of the class described which universally fits all flat, round or irregular surface wood posts as well as standard steel "T" posts, standard round ¼ inch to 9/16 inch metal posts and rebar posts.

Another object of this invention is the provision of a fence post bracket of the class described which additionally permits installation of the bracket on the reverse side of "T" posts.

A further object of this invention is the provision of a fence post bracket of the class described which is configured to mount a removable wire extension member for spacing a fence wire an additional distance from a fence post as needed to enhance electric arcing protection oftentimes experienced with high voltage electrified fences.

A further object of this invention is the provision of a fence post bracket of the class described which permits direct horizontal installation of wire onto the bracket, thus avoiding the heretofore common need of manipulating wires by bending and turning in order to capture the wire on the bracket, and thereby reduce installation labor time and effort and undue stress on the wire and the bracket fingers.

A still further object of this invention is the provision of a fence post bracket of the class described which eliminates the heretofore necessary production of a great number of differently configured brackets, and the significant difficulties and expenses associated with maintaining inventories adequate to satisfy the needs of the marketplace.

The foregoing and other objects and advantages of this invention will appear from the following detailed description, taken in connection with the accompanying drawings of a preferred embodiment.

DESCRIPTION OF THE PREFERRED EMBODIMENT

Figure 1:
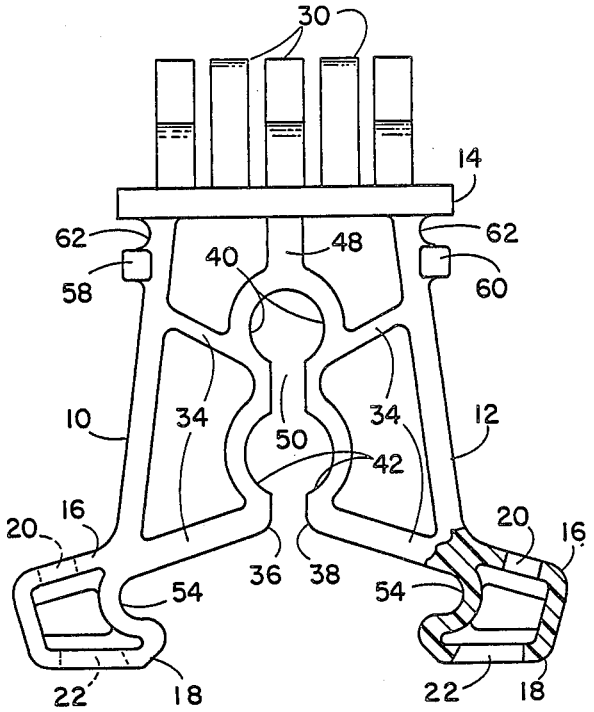
FIG. 1 is a plan view of an electric wire supporting fence post bracket embodying the features of this invention, a portion being broken away to disclose internal structural details.
Figure 2:
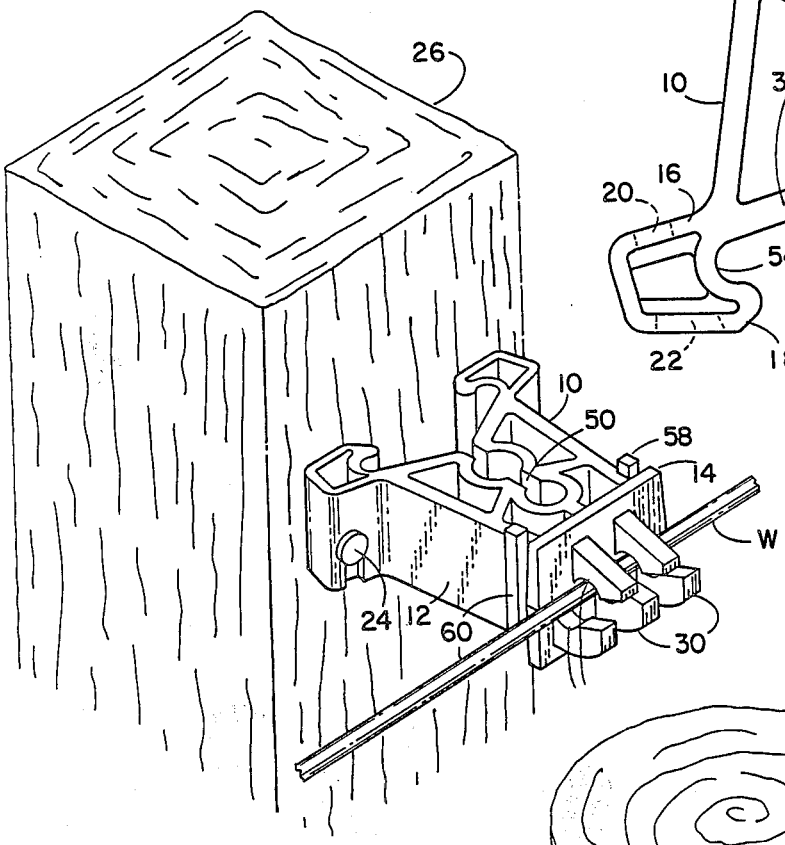
FIG. 2 is a perspective view of the bracket of FIG. 1 mounted to the flat surface of a wood post and supporting a fence wire.
Figure 3:
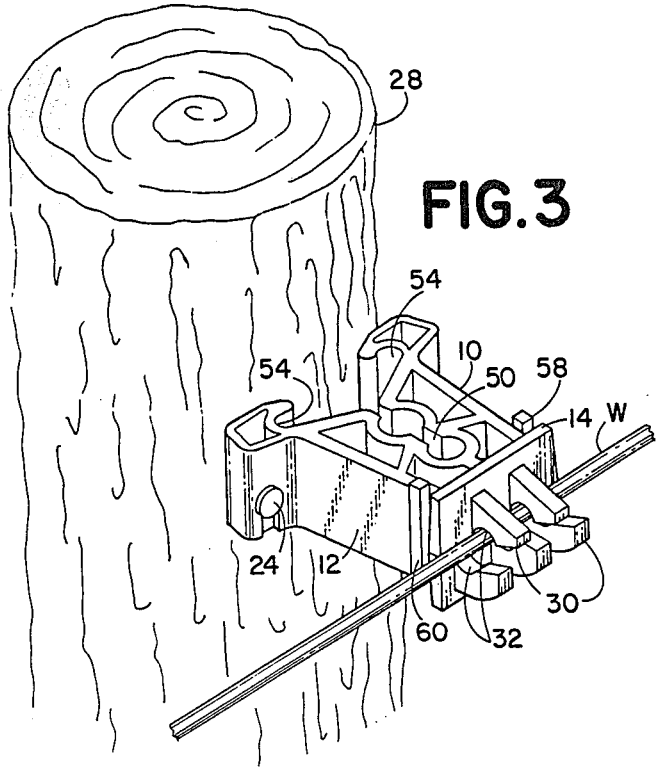
FIG. 3 is a perspective view of the bracket of FIG. 1 mounted to a conventional round wood fence post.

The present invention provides a fence post bracket that is configured to support an electric fence wire, either of the barbed type or smooth type, the bracket configured for mounting on any conventional fence post typically used in the art. Toward this end, the insulator bracket of this invention is formed as a unitary, one-piece body of electrically non-conductive material, such as a high density polyethylene or other suitable synthetic resin subjected to conventional plastic molding techniques. The body includes a pair of laterally spaced legs 10 and 12 joined at their outer ends to a spark shield 14 and supporting at their inner ends laterally spaced feet. Each foot includes outwardly spaced sections 16 and 18 provided with aligned openings 20 and 22, respectively, for the reception of an anchor nail 24 by which to attach the insulator to a wooden fence post, such as the rectangular post 26 in FIG. 2 and the round post 28 in FIG. 3. The openings 22 are elongated laterally to allow angling of the nails 24, to facilitate anchoring to the round or flat surfaces of the fence posts.

Extending outwardly from the spark shield in the direction opposite the legs 10 and 12 are a plurality of laterally spaced fingers 30. Five fingers are preferably provided, alternate ones of which are spaced apart vertically and provided with alternately facing grooves 32 which are in lateral alignment for the reception of a length of electric fence wire W. The provision of five fingers, with two fingers facing three fingers, ensures against failure of the wire support in the event one of the fingers is broken.

Figure 6:
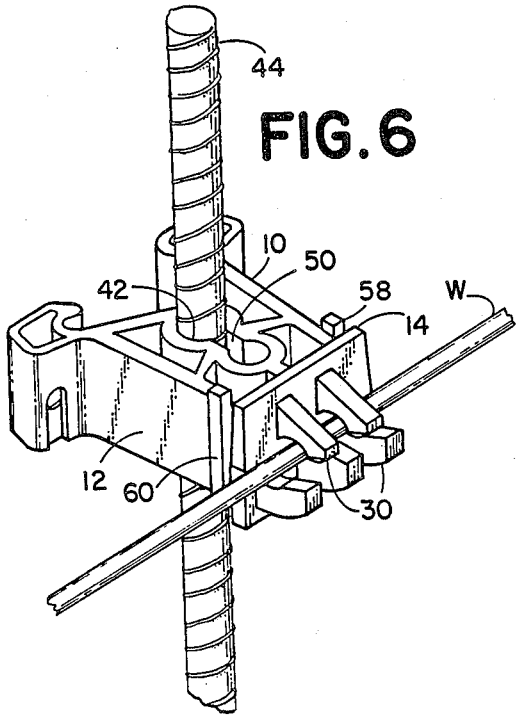
FIGS. 6 and 7 are perspective views of the bracket of FIG. 1 illustrating its mount on conventional round rod fence posts of different diameters.
Figure 7:
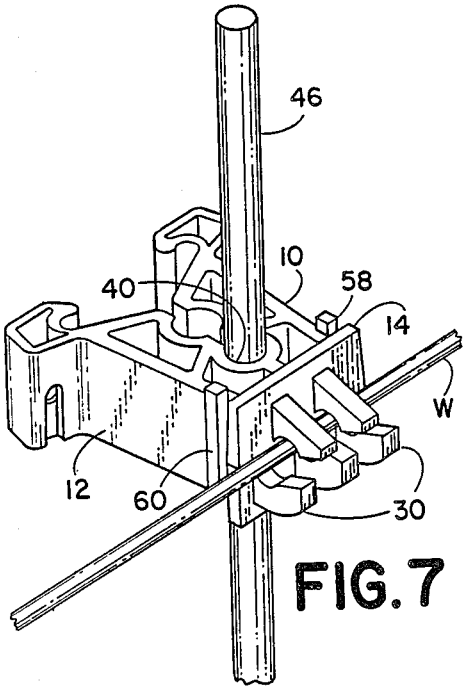

Extending laterally inward from the legs 10 and 12 are webs 34 which support at their inner ends a pair of laterally spaced secondary legs 36 and 38. Each secondary leg has a pair of outwardly spaced arcuate sections 40 and 42 of different radius. The confronting pairs of sections 40, 40 and 42, 42 form open or split circular retainers for resiliently gripping rod type fence posts of different diameters, as illustrated by rods 44 and 46 in FIGS. 6 and 7, respectively.

The outer ends of the secondary legs 36, 38 may be secured together and also to the spark shield 14 for reinforcement, as by the connecting web 48.

Figure 4:
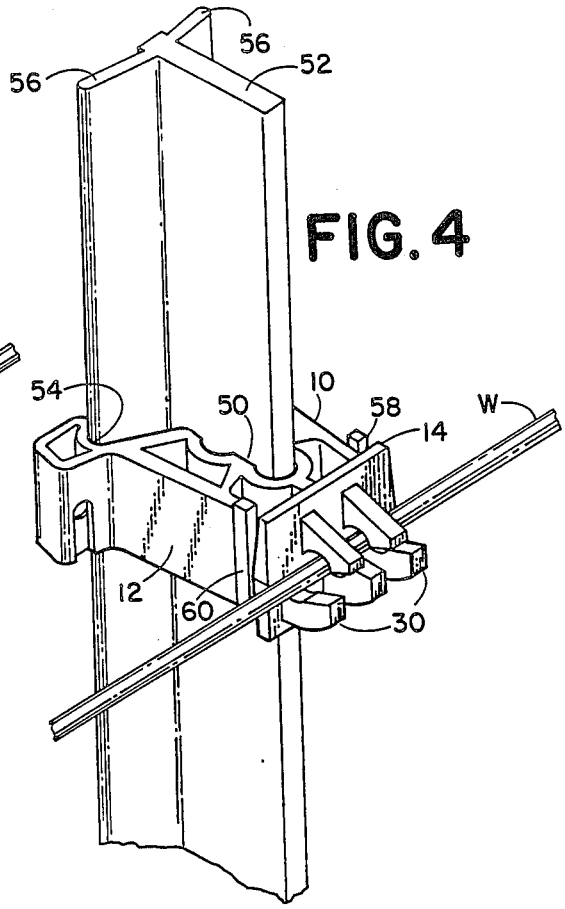
FIG. 4 is a perspective view of the bracket of FIG. 1 illustrating its mount on a conventional "T" type metal fence post.

The space 50 between the spaced arcuate sections of the secondary legs affords reception of the leg 52 of a "T" type fence post (FIG. 4). Arcuate sockets 54 in the inner sides of the legs 10 and 12 are configured to resiliently receive the arms 56 of the "T" type fence post (FIGS. 4 and 5).

Figure 8:
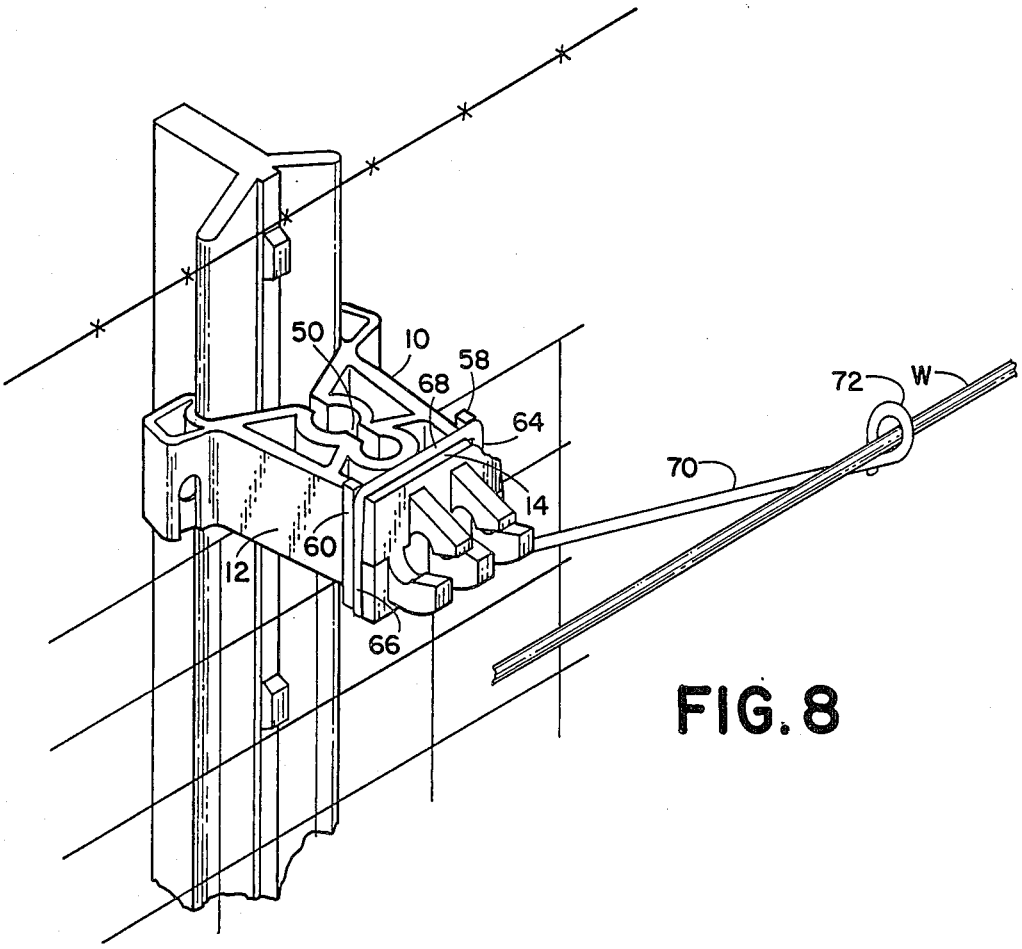
FIG. 8 is a perspective view of the bracket of FIG. 1 mounting a removable wire extension member configured to support a fence wire a greater spaced distance away from a supporting fence post.

Inwardly of the spark shield 14, the legs 10 and 12 support a pair of shoulder members 58 and 60 which cooperate with the spark shield to form grooves 62 for the removable reception of the spaced legs 64 and 66 of a U-shaped clip section 68 of a wire stand-off member (FIG. 8). This member includes an elongated stand-off wire 70 extending outwardly from the leg 64, and it preferably terminates in an outer open loop 72 configured to removably receive a fence wire W. It will be appreciated that the elongated stand-off wire 70 may be configured to project any desired distance outwardly from its mount at the bracket. As an example, 5–9 inches in overall length is preferred in order to prevent potential electrical arcing that may occur when high voltage electrical fencing is used.

The installation of the bracket of this invention is readily apparent from the drawings. In installations involving wood posts, the bracket is simply positioned in a desired location against a post, and nails 24 are driven through the openings 20, 22 in the feet members, securing the bracket in position. In installations involving the "T" type posts illustrated in FIGS. 4 and 5, the bracket is simply fitted on top of the post and slid downward into place where it is held by frictional engagement. Unlike other brackets known in the art, the bracket of this invention is capable of being mounted to "T" type fence posts in the alternately reversed positions of FIGS. 5 and 6.

Figure 5:
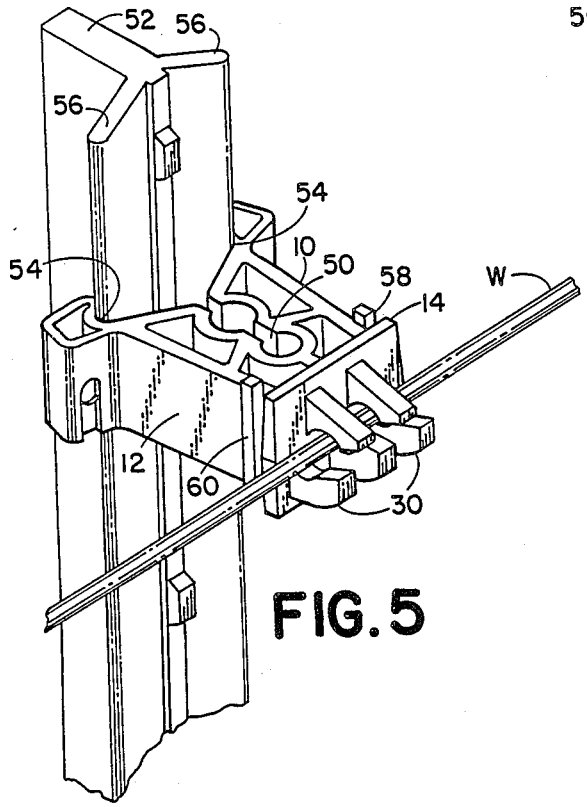
FIG. 5 is a perspective view of the bracket of FIG. 1 illustrating its mount on a conventional "T" type metal fence post in the reverse direction from that shown in FIG. 4.

Installations of the bracket on round rod type fence posts (FIGS. 6 and 7) is similar to installation of the bracket on the "T" type fence post of FIGS. 4 and 5. Depending on the diameter of the rod type post, the appropriate sized opening 40, 42 is selected and the bracket placed on the rod and slid downward to a desired elevation above ground. The frictional engagement of the rod post in the selected opening 40, 42 secures the bracket in desired position.

Once a bracket is positioned in a desired location on a post, the elongated fence wire W is simply pressed into engagment between the fingers 30. Alternatively, the stand-off wire 70 may be attached by simply engaging the clip section 68 of the stand-off wire with the groove section 62 of the bracket and the fence wire is placed into the open loop 72 at the outer terminal end of the stand-off wire.

It will be apparent that various changes may be made in the structural details described hereinbefore. For example, the wooden posts 26 and 28 may be replaced with metal posts of similar shapes, in which case the nails 24 will be replaced with screws or bolts for securing the insulator. These and other changes may be made, as desired, without departing from the spirit of this invention and the scope of the appended claims.

I claim:

1. An electric fence wire insulator formed as a unitary body of electrical insulation material and defining:

(a) a transversely disposed spark shield, (b) a pair of laterally spaced legs extending from the spark shield and terminating in foot members having surfaces disposed substantially parallel to the spark shield for abutment against a fence post, (c) the foot members having openings through said surfaces for reception of fastener means for securing the foot members to the outer arcuate or flat surface of a fence post, (d) a pair of inwardly facing, mutually confronting socket members one on the inner side of each leg adjacent the foot members configured to removably receive and frictionally retain therein the laterally extending arms of a T-type fence post, and (e) wire retainer means on the side of the spark shield opposite the legs for removably securing an electric fence wire to the insulator.

2. The electric fence wire insulator of claim 1 wherein the wire retainer means comprises five laterally spaced fingers projecting from the spark shield in the direction away from the legs, alternate fingers being spaced apart vertically and provided with inwardly facing, laterally aligned grooves for the removable reception of an electric fence wire.

3. The electric fence wire insulator of claim 1 including a stand-off member having a mounting end configured for removable attachment to the insulator body, an intermediate elongated section extending from and substantially perpendicular to the mounting end, and a retainer end on the end of the elongated section opposite the mounting end for removably retaining an electric fence wire.

4. The electric fence wire insulator of claim 3 wherein the mounting end of the stand-off member is configured as a resilient U-shaped section, and there are shoulder means on the outer side of each leg spaced from and extending substantially parallel to the spark shield and forming a pair of grooves therebetween for removably receiving therein the U-shaped section of the stand-off member.

5. An electric fence wire insulator formed as a unitary body of electrical insulation material and defining:

(a) a transversely disposed spark shield, (b) a pair of laterally spaced legs extending from the spark shield and terminating in foot members for abutment against a fence post, (c) the foot members having openings therethrough for reception of fastener means for securing the foot members to the outer arcuate or flat surface of a fence post, (d) a pair of inwardly facing socket members on the inner sides of the legs adjacent the foot members configured to removably receive and frictionally retain therein the laterally extending arms of a T-type fence post, (e) a pair of laterally spaced secondary legs inwardly of the first named pair of legs, the secondary legs having at least one pair of registering arcuately concave segments facing each other and forming a split circular retainer for the removable reception and resilient gripping therein of a rod type fence post of circular cross-section, and (f) wire retainer means on the side of the spark shield opposite the legs for removably securing an electric fence wire to the insulator.

6. The electric fence wire insulator of claim 5 wherein the space between the facing registering arcuate concave segments of the secondary legs is configured to removably receive therein the leg of a T type fence post.

7. The electric fence wire insulator of claim 5 wherein the secondary legs have at least two split circular retainers spaced apart longitudinally between the foot members and spark shield, the retainers being of different diameters for the reception of rod type fence posts of different cross-sectional diameters.

8. The electric fence wire insulator of claim 7 wherein the space between the facing registering arcuate concave segments of the secondary legs is configured to removably receive therein the leg of a T type fence post.

9. An electric fence wire insulator formed as a unitary body of electrical insulation material and defining:

(a) a transversely disposed spark shield, (b) a pair of laterally spaced legs extending from the spark shield and terminating in foot members for abutment against a fence post, (c) the foot members having openings therethrough for reception of fastener means for securing the foot members to the outer arcuate or flat surface of a fence post, (d) a pair of inwardly facing socket members on the inner sides of the legs adjacent the foot members configured to removably receive and frictionally retain therein the laterally extending arms of a T type fence post, (e) wire retainer means on the side of the spark shield opposite the legs for removably securing an electric fence wire to the insulator, the wire retainer means comprising five fingers projecting from the spark shield in the direction away from the legs, alternate fingers being spaced apart vertically and provided with inwardly facing, laterally aligned grooves for the removable reception of an electric fence wire, and (f) a pair of laterally spaced secondary legs inwardly of the first named pair of legs, the secondary legs having at least two pairs of registering arcuately concave segments facing each other and forming at least two split circular retainers spaced apart longitudinally between the foot members and spark shield, the retainers being of different diameters for the reception of rod type fence posts of different cross sectional diameters, (g) the space between the facing registering arcuately concave segments of the secondary legs being configured to removably receive therein the leg of a T type fence post.

10. The electric fence wire insulator of claim 9 including a stand-off member having a mounting end configured for removable attachment to the insulator body, an intermediate elongated section extending from the mounting end, and a retainer end on the end of the elongated section opposite the mounting end for removably retaining an electric fence wire.

11. The electric fence wire insulator of claim 10 wherein the mounting end of the stand-off member is configured as a resilient U-shaped section, and there are shoulder means on the legs spaced from the spark shield and forming a pair of grooves therebetween for removably receiving therein the U-shaped section of the stand-off member.

* * * * *